United States Patent [19]

Matsuda

[11] 4,190,935

[45] Mar. 4, 1980

[54] SLIDE FASTENER STRINGER

[75] Inventor: Yoshio Matsuda, Nyuzen, Japan

[73] Assignee: Yoshida Kogyo K.K., Tokyo, Japan

[21] Appl. No.: 873,489

[22] Filed: Jan. 30, 1978

[30] Foreign Application Priority Data

Feb. 8, 1977 [JP] Japan ..... 52/14115[U]

[51] Int. Cl.[2] ..... A44B 19/00

[52] U.S. Cl. ..... 24/205.16 C; 66/195

[58] Field of Search ..... 66/195; 24/205.16 C, 24/205.16 R

[56] References Cited

U.S. PATENT DOCUMENTS

| | | | |
|---|---|---|---|
| 2,264,324 | 12/1941 | Morin | 24/205.16 R |
| 2,264,325 | 12/1941 | Morin | 24/205.16 R |
| 2,264,326 | 12/1941 | Morin | 24/205.16 R |
| 2,651,092 | 9/1953 | Poux | 24/205.16 R |
| 3,848,556 | 11/1974 | Terada et al. | 66/195 X |
| 3,849,842 | 11/1974 | Yoshida | 66/195 X |
| 3,874,036 | 4/1975 | Yoshikawa | 24/205.1 C |
| 3,922,760 | 12/1975 | Matsuda | 24/205.1 C |
| 4,051,579 | 10/1977 | Heimberger | 24/205.16 R |
| 4,067,208 | 1/1978 | Heimberger | 24/205.16 C |

FOREIGN PATENT DOCUMENTS

| | | | |
|---|---|---|---|
| 2200444 | 7/1973 | Fed. Rep. of Germany | 24/205.16 C |
| 2546962 | 4/1976 | Fed. Rep. of Germany | 66/195 |
| 2626662 | 12/1977 | Fed. Rep. of Germany | 205/16 R |
| 1444599 | 8/1976 | United Kingdom | 66/195 |

*Primary Examiner*—Ronald Feldbaum

*Attorney, Agent, or Firm*—Bucknam and Archer

[57] ABSTRACT

A slide fastener stringer includes a stringer tape of a warp-knit structure and a series of discrete or separate fastener elements mounted on and along one longitudinal edge of the stringer tape. The stringer tape has a reinforcing cord laid therein or inserted in an outermost groove between adjacent two wales of the tape, the cord extending warpwise and being thicker than the threads forming the tape fabric. The reinforcing cord is stitched with lock or double locked stitches at intervals spaced along the tape, thereby providing an element-anchoring bead on the tape. A pair of additional threads are preferably interlaced with the stitches and are disposed on the flat surface of the tape.

8 Claims, 8 Drawing Figures

SLIDE FASTENER STRINGER

BACKGROUND OF THE INVENTION

The present invention relates to a slide fastener stringer having a warp-knit stringer tape with a series of discrete or separate fastener elements mounted on and along its one longitudinal edge.

SUMMARY OF THE INVENTION

According to the present invention, a slide fastener stringer tape of a warp-knit structure has a reinforcing cord disposed at a groove between adjacent wales which is located adjacent to a longitudinal edge of the tape. The reinforcing cord is sewn with stitches extending across and through the cord and stringer tape at spaced intervals along the tape. A series of discrete fastener elements is mounted on and along the longitudinal tape edge in clamping engagement with the reinforcing cord and sewing stitches over the longitudinal tape edge.

It is an object of the present invention to provide a slide fastener stringer having a warp-like stringer tape with a series of discrete fastener elements mounted thereon with an increased degree of anchoring strength.

Another object of the present invention is to provide a slide fastener stringer which is relatively flexible.

The above and other objects and advantages will become apparent from the following description when taken in conjunction with the accompanying drawings which illustrate, by way of example, some preferred embodiments of the invention.

DETAILED DESCRIPTION OF THE PREFERRED EMBODIMENTS

Figure 1:
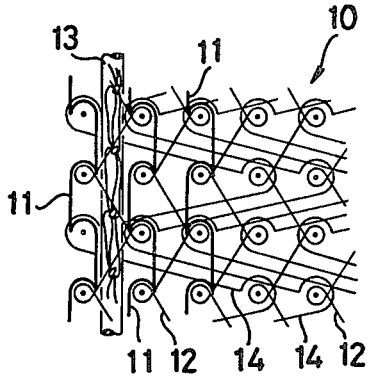
FIG. 1 is a diagrammatic view showing the stitch patterns of a warp-knit stringer tape according to the present invention.

As shown in FIG. 1, a slide fastener stringer tape 10 has a warp-knit structure made on a knitting machine with four guide bars. The stringer tape 10 includes chain or pillar stitches 11 formed with warp threads provided through three consecutive guides of the first guide bar. The second guide bar is all threaded and its pattern-wheel set-up is 1-0,1-2 (under 1 over 1) for thereby producing so-called tricot stitches 12.

The third guide bar carries one warp thread and makes no shogging movement. The warp thread provided by the third guide bar is a reinforcing cord 13 laid in the warp-knit structure and extending warpwise between a pair of outer chain stitches 11,11. The fourth guide bar is threaded with warp threads, three out, having a stitch pattern of 0-1,4-3 (under 3 over 1), which is sometimes referred to as a single cord stitch 14. The reinforcing cord 13 is thicker in diameter than the other warp threads forming the chain, tricot, and single cord stitches 11, 12, and 14, and may be of multiple filamentary structure such as a plurality of stranded yarns, for example.

Figure 2A:
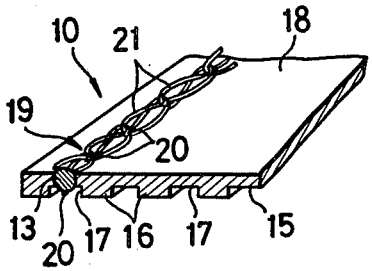
FIG. 2A is a fragmentary perspective view of the stringer tape shown in FIG. 1.
Figure 2B:
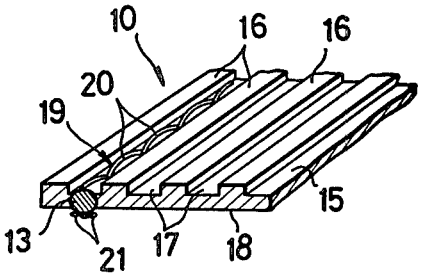
FIG. 2B is a view similar to FIG. 2A, showing the tape face down.

In FIGS. 2A and 2B, the warp-knit stringer tape 10 has on its wrong surface 15 a plurality of longitudinal wales 16 and a plurality of longitudinal grooves 17 each extending between every adjacent wales, the right surface 18 of the tape 10 being substantially flat relative to the wrong surface 15. Sewing stitches 19 such as double locked stitches extend across and through the reinforcing cord 13 and stringer tape fabric at spaced intervals along the tape 10. More specifically, the double locked stitches include a needle thread 20 penetrating the reinforcing cord 13 and stringer tape fabric and a looper thread 21 interlaced and interlooped with the portions of the needle thread 20 that are on the flat right surface 18, the looper thread 21 being disposed as protuberances on the flat right surface 18 (FIG. 2A). In the groove 17 where the reinforcing cord 13 is located, there are portions of the needle thread 20 which project away from the reinforcing cord 13 between the adjacent wales 16,16.

Figure 3A:
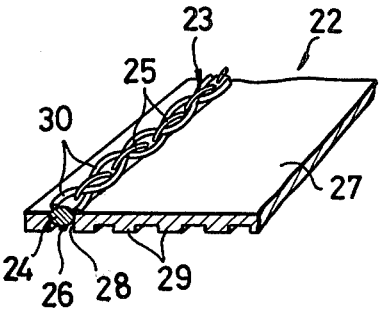
FIG. 3A is a fragmentary perspective view of a stringer tape provided in accordance with a modification.
Figure 3B:
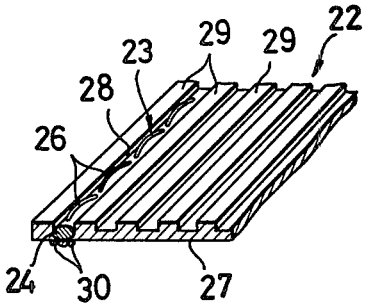
FIG. 3B is a view similar to FIG. 3A, showing the tape turned upside down.

Accordingly, the reinforcing cord 13, the looper thread 21, and the portions of the needle thread 20 protruding into the outermost groove 17 jointly provide a bead on and around which a series of discrete fastener elements are clamped and held securely in position by direct gripping engagement therewith, as described later on in connection with a modification as illustrated in FIGS. 3A and 3B.

According to a modified slide fastener stringer tape 22 as shown in FIGS. 3A and 3B, lock stitches 23 extend at spaced intervals across and through a reinforcing cord 24 laid in and extending warpwise of the stringer tape 22 having a warp-knit construction that is structurally similar to the warp-knit stringer tape 10 shown in FIG. 1. The lock stitches 23 are composed of a needle thread 25 and a bobbin thread 26 interlaced with the needle thread 25, the needle thread 25 being on the side of the flat surface 27 of the stringer tape 22. The bobbin thread 26 has portions projecting into an outermost groove 28 between adjacent wales 29,29 on the other surface of the stringer tape 22. Interlaced with the needle thread 25 are a pair of additional threads 30,30 disposed on the flat surface 27, the additional threads 30,30 being thicker in diameter than the needle and the bobbin threads 25,26. The pair of additional threads 30,30 repeatedly cross the needle thread 25 and each other at spaced intervals along the stringer tape 22.

A pair of thread holders (not shown) are provided, one for each additional thread, the holders being located over the throat plate of a sewing machine and upstream of the sewing needle. The thread holders feed the additional threads 30,30 to a point where the sewing needle stitches the stringer tape. The thread holders are reciprocatable with a phase displacement of 180 degrees such that the additional threads supplied thereby are caused to cross each other by the reciprocations of the thread holders. In operation, when the sewing needle is in its uppermost position, the thread holders are spaced apart from each other. As the sewing needle is lowered toward its lowermost position and penetrates the tape 22, the thread holders move toward each other and the additional threads 30,30 begin to surround the needle thread 25. When the sewing needle is moved up toward its uppermost position, the thread holders are spaced apart from each other after having passed one another, whereupon the additional threads 30,30 have crossed each other with the needle thread 25 between them. Thus, the additional threads 30,30 cross the needle thread 25 and each other, as illustrated in FIG. 3A.

Figure 4:
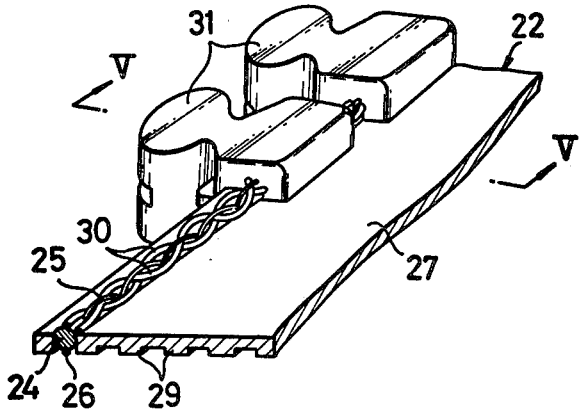
FIG. 4 is a fragmentary perspective view of the stringer tape of FIGS. 3A and 3B with discrete fastener elements mounted on its one longitudinal edge.
Figure 5:
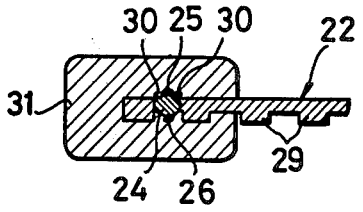
FIG. 5 is a cross-sectional view taken along line V—V of FIG. 4.

A series of discrete or separate fastener elements 31 (only two shown in FIG. 4 for clarity) are mounted on and spaced along a longitudinal edge of the stringer tape 22, carrying the stitched reinforcing cord 24 therealong, in direct clamping engagement with the cord 24, sewing stitches 23, and additional threads 30,30, over and around the longitudinal edge of the stringer tape 22, as better shown in FIG. 5. Where the fastener elements 31 are made of synthetic resin, they are injection-molded on the stringer tape edge. Where the fastener elements 31 are made of metal, they are formed on the stringer tape edge by die casting. At any rate, the fastener elements 31 are anchored in place and prevented from getting loose by gripping engagement with the sewing stitches 23 and additional threads 30,30 on the stringer tape 22.

Figure 6:
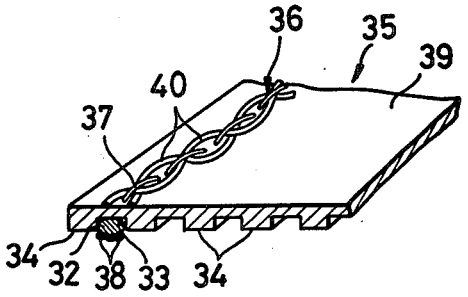
FIG. 6 is a fragmentary perspective view of another modified stringer tape.

FIG. 6 shows another modification in which a reinforced cord 32 is inserted in an outermost groove 33 between adjacent wales 34,34 on the wrong surface of a warp-knit stringer tape 35 that also is structurally similar to the warp-knit stringer tape 10 shown in FIG. 1 except that the reinforcing cord 32 is not laid warpwise in the stringer tape 35. The stringer tape 35 can be knitted on a knitting machine using three guide bars. Double locked stitches 36 are employed to secure the reinforcing cord 32 to the stringer tape 35, the double locked stitches 36 including a needle thread 37 passing across and through the tape fabric and reinforcing cord 32, and a looper thread 38 interlaced and interlooped with the needle thread 37. The looper thread 38 is positioned on and extends along the reinforcing cord 32, the looper thread 38 being located downwardly beyond the wales 34. The needle thread 37 has portions appearing on the right surface 39 of the tape 35 that is substantially flat, the portions of the needle thread 37 being interlaced with a pair of additional threads 40,40 that are thicker in diameter than the needle and the looper threads 37,38. The additional threads 40,40 are disposed on the flat tape surface 39 and repeatedly cross the needle thread 37 and each other at spaced locations along the tape 35. The modified stringer tape 35 shown in FIG. 6 provides an element-anchoring bead which can retain fastener elements more stably because both the sewing stitches 36 and the additional threads 40,40 act for engagement with the fastener elements on the opposite surfaces of the stringer tape 35.

The slide fastener stringers according to the present invention are advantageous in that they support the fastener elements securely thereon, yet because of a single reinforcing cord employed are flexible enough to permit themselves to be applied to relatively thin, flexible garments.

Although the present invention has been shown and described in connection with its preferred embodiments, it should be understood that various changes and modifications may be made without departing from the scope of the appended claims.

I claim as my invention:

1. A slide fastener stringer comprising:
(a) a stringer tape of a warp-knit structure having on its one surface a plurality of longitudinal wales and a plurality of longitudinal grooves each extending between every adjacent wales, the other surface of said stringer tape being relatively flat;
(b) a single reinforcing cord disposed at one of said grooves which is located adjacent to one longitudinal edge of said stringer tape, said reinforcing cord extending longitudinally in said groove;
(c) sewing stitches extending across and through said reinforcing cord and stringer tape at spaced intervals along said stringer tape, said sewing stitches having portions which form protuberances on said other surface; and
(d) a series of discrete fastener elements mounted on and spaced along said one longitudinal edge of the stringer tape in clamping engagement with said reinforcing cord and sewing stitches including said portions over said one longitudinal edge of the stringer tape, said fastener elements being secured to the stringer tape solely by said clamping engagement.

2. A slide fastener stringer according to claim 1, said reinforcing cord comprising a warp thread laid in said warp-knit stringer tape.

3. A slide fastener stringer according to claim 1, said reinforcing cord being inserted in said one of said grooves.

4. A slide fastener stringer according to claim 1, said sewing stitches comprising double locked stitches including a looper thread disposed on said other surface.

5. A slide fastener stringer according to claim 1, including a pair of additional threads interlaced with said sewing stitches, and said additional threads being disposed on said other surface.

6. A slide fastener stringer according to claim 5, said sewing stitches including a needle thread, and each of said additional threads being thicker than said needle thread.

7. A slide fastener stringer according to claim 5, said sewing stitches comprising lock stitches including a needle thread, and said additional threads being interlaced with said needle thread and crossing each other repeatedly at said spaced intervals.

8. A slide fastener stringer according to claim 5, said sewing stitches comprising double locked stitches including a needle thread, and said additional threads being interlaced with said needle thread and crossing each other repeatedly at said spaced intervals.

* * * * *